US006847782B1

(12) United States Patent
Kovacs

(10) Patent No.: US 6,847,782 B1
(45) Date of Patent: Jan. 25, 2005

(54) HOT WATER DISPENSING SYSTEM

(75) Inventor: Walter Kovacs, Lake Arrowhead, CA (US)

(73) Assignee: Anaheim Manufacturing Company, Anaheim, CA (US)

( * ) Notice: Subject to any disclaimer, the term of this patent is extended or adjusted under 35 U.S.C. 154(b) by 0 days.

(21) Appl. No.: 10/626,072

(22) Filed: Jul. 23, 2003

(51) Int. Cl.[7] ..... F24H 1/20
(52) U.S. Cl. ..... 392/451; 392/441
(58) Field of Search ..... 392/441, 465, 392/488, 485

(56) References Cited

U.S. PATENT DOCUMENTS 4,263,498 A * 4/1981 Meyers ..... 392/451
5,778,679 A * 7/1998 Celorier et al. ..... 62/47.1

* cited by examiner

*Primary Examiner*—Thor Campbell
(74) *Attorney, Agent, or Firm*—Kenneth W. Float

(57) ABSTRACT

Hot water dispersing systems having a self-resetting heater control switch that prevents heater burn-up if the water tank becomes empty, and a variable volume expansion chamber having a flexible bladder that is designed to withstand a pressure of at least 300 pounds per square inch.

16 Claims, 10 Drawing Sheets

Fig. 4
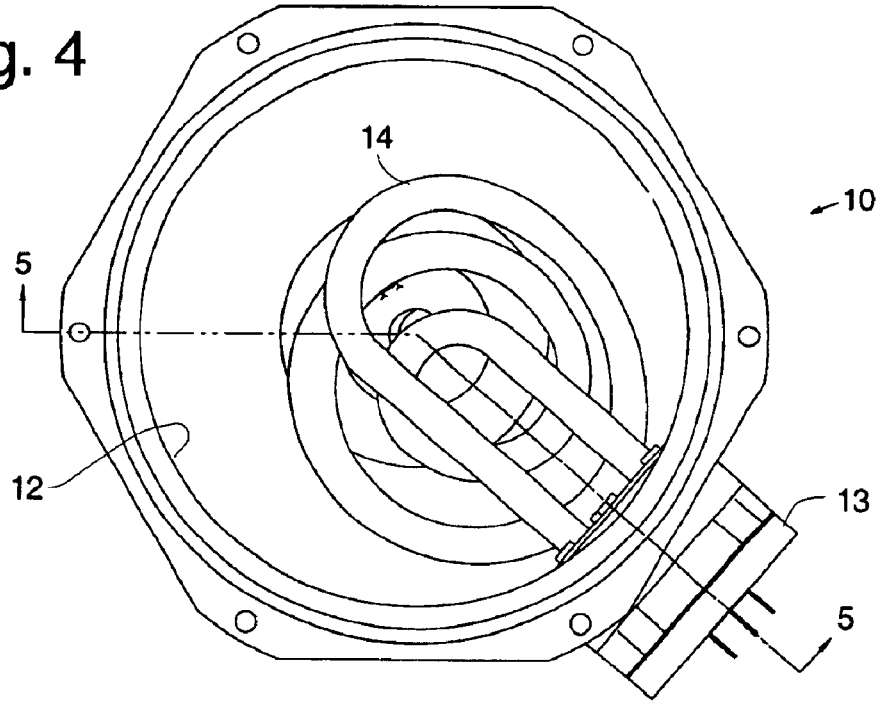
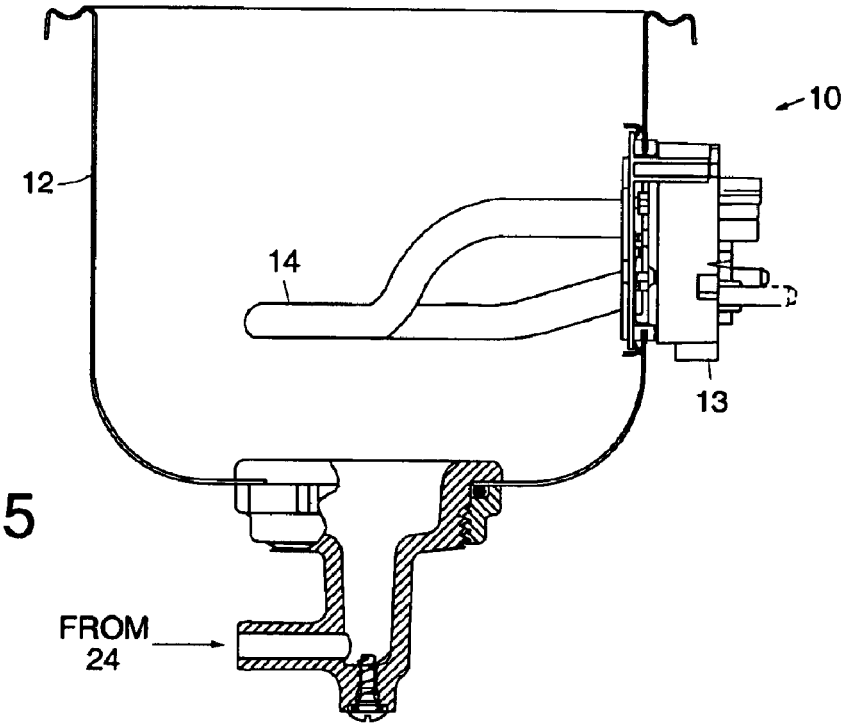
Fig. 5

FIG. 6
NON-DISPENSING/HEATING MODE
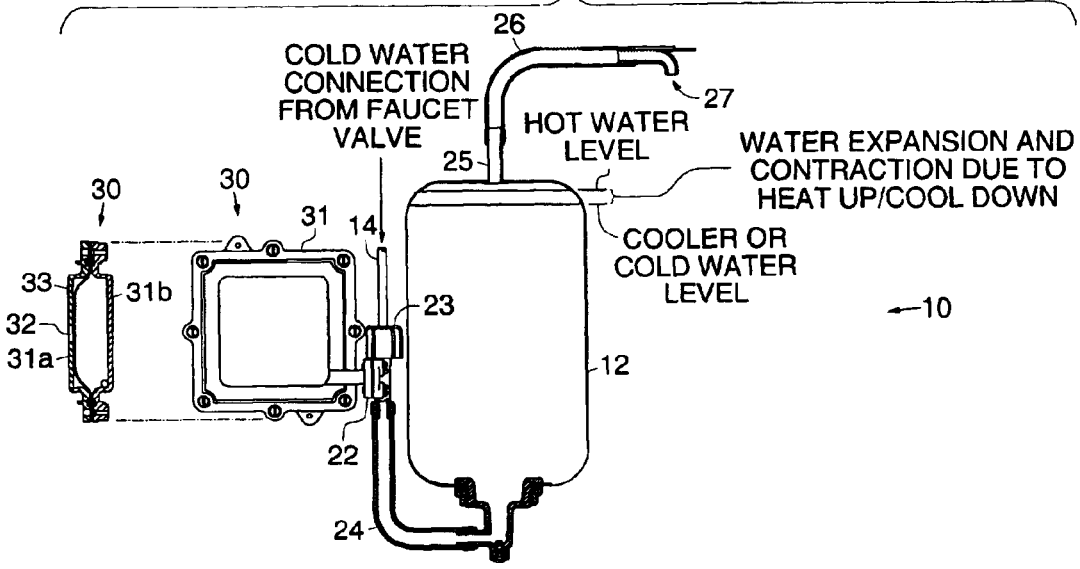
FIG. 7
DISPENSING MODE
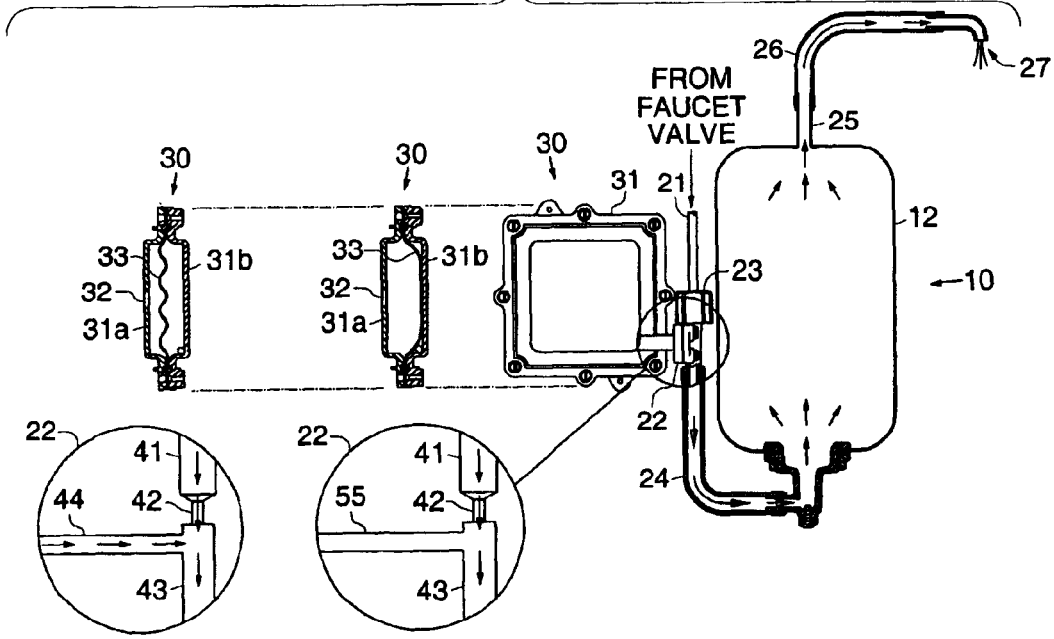
FIG. 7a FIG. 7b

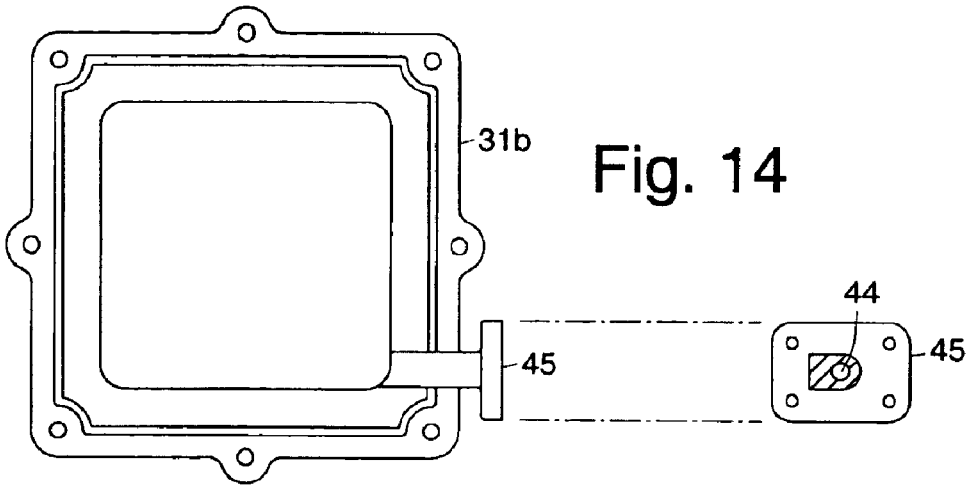
Fig. 14
Fig. 15
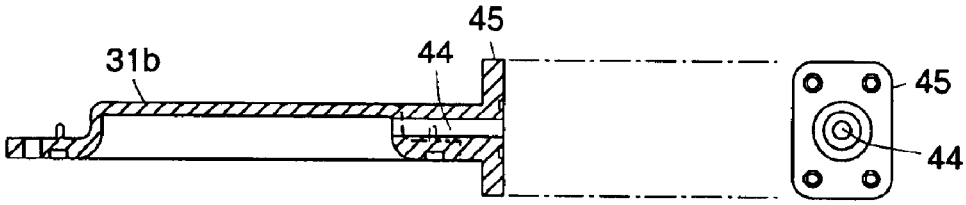
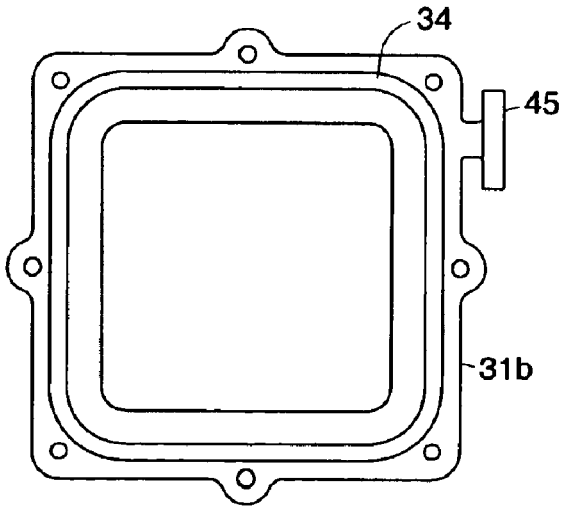
Fig. 16

HOT WATER DISPENSING SYSTEM

BACKGROUND

The present invention relates to hot water dispensing systems, and more particularly to an improved hot water dispensing system having a self-resetting heater control switch that prevents heater burn-up and a variable volume expansion chamber that can withstand pressure greater than 300 pounds per square inch.

As for prior art known to the inventor, with regard to heater burn-up, certain KitchenAid brand hot water dispensing systems employ a one time non-resetable fuse that must be replaced if it burns out. Replacement of the fuse is not an easy task. ISE manufactures a hot water dispensing system that uses a manual resetable fuse device. However, this resetable fuse device is disposed within a housing and requires removal of a cover plate to reset it.

Also, it is believed that a heater control incorporating a shut-off switch similar to the device used in the present invention, is used in tea kettles in the United Kingdom. However, this type of device is not used in any heating device employed in hot water dispensing systems.

With regard to expansion chambers used in hot water dispensing systems, KitchenAid uses a non-enclosed variable volume expansion chamber that bursts at around 30 pounds per square inch. A check valve is required to prevent bursting of the expansion chamber when used with certain types of faucets. ISE manufactures a hot water dispensing system that employs a fixed volume expansion chamber that will not burst, but eventually will leak water through a vent tube. A check valve is also required to prevent this condition.

Accordingly, it would be advantageous to have improved hot water dispensing systems that overcome limitations of conventional systems.

SUMMARY OF THE INVENTION

The present invention overcomes the difficulties of the above-described conventional systems and provides for improved hot water dispensing systems. Exemplary hot water dispensing system comprise an outer housing that encloses a water tank having an inlet and an outlet. A heating element is disposed inside of the water tank and is coupled to a heater control. A thermostat is electrically connected to the heater control that senses and controls the temperature of water in the water tank in conjunction with the heater control and heating element An inlet tube provides a connection to a cold water source. An orifice block has an input passage coupled to the inlet tube, a suction passage, and an outlet passage coupled to the inlet of the water tank. A variable volume expansion chamber comprising flexible internal bladder is coupled to the suction passage of the orifice block. A discharge hose coupled to the outlet of the water tank for connection to a faucet.

The hot water dispensing systems preferably comprise a self-resetting heater control switch that is preferably part of the heater control that prevents heating element burn-up if the tank becomes empty. The self-resetting heater control switch comprises bimetallic switch contacts in the heater control that open and turn off power to the heating element if the temperature of the heating element rises due to the fact that there is no water in the water tank.

The variable volume expansion chamber enclosed within the housing is preferably designed to withstand a pressure of at least, and generally greater than, 300 pounds per square inch. A reduced-to-practice embodiment of the variable volume expansion chamber has been tested to 300 PSI will not see more pressure that will be generated by household water supplies. The variable volume expansion chamber and its ability to withstand high pressures are particularly significant when used in dual lever hot/cold faucets when both levers are depressed simultaneously.

BRIEF DESCRIPTION OF THE DRAWINGS

The various features and advantages of the present invention may be more readily understood with reference to the following detailed description taken in conjunction with the accompanying drawings, described by way of example, and wherein like reference numerals designate like structural elements, and in which:

FIGS. 4 and 5 illustrate an exemplary heater control and heating element, respectively, that may be used in the present hot water dispensing systems;

FIGS. 6 and 7 illustrate additional details of the hot water dispensing systems along with operation of the present invention;

FIGS. 14, 15 and 16 illustrate outside, cross-sectional and inside views, respectively, of a second mating section of the exemplary variable volume expansion chamber housing shown in FIGS. 6 and 7;

DETAILED DESCRIPTION

Figure 1:
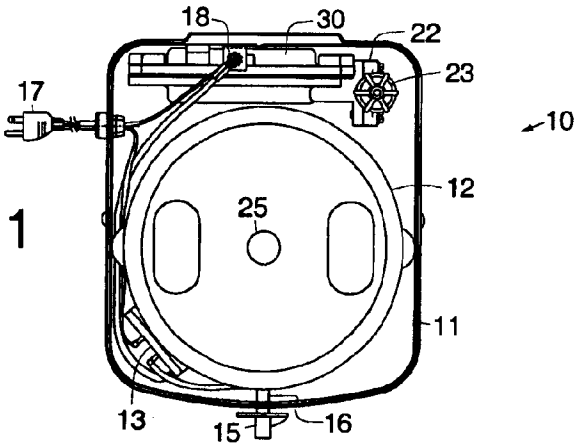
FIGS. 1–3 are cross-sectional top, plan and side views, respectively, of exemplary hot water dispensing systems in accordance with the principles of the present invention.
Figure 2:
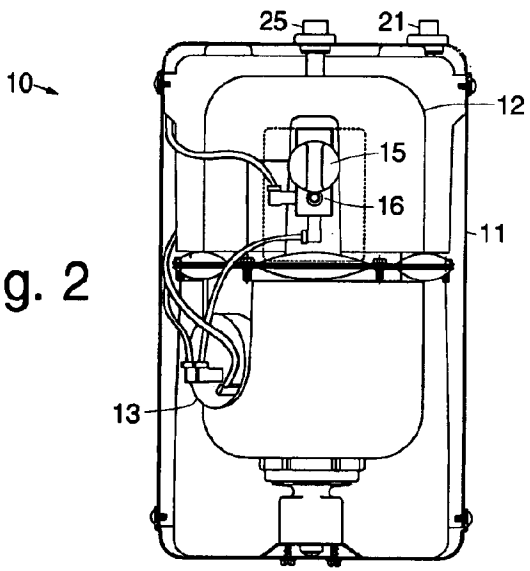
Figure 3:
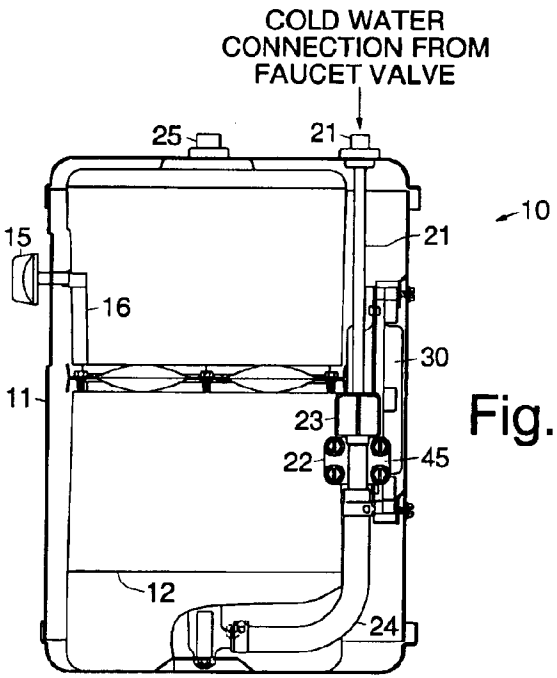

Referring to the drawing figures, FIGS. 1–3 are cross-sectional top and side views, respectively, that illustrate an exemplary hot water dispensing system 10 in accordance with the principles of the present invention. The exemplary hot water dispensing system 10 comprises an outer housing 11, which may be made of plastic or metal (such as stainless steel), for example. A water tank 12, which may be made of plastic, for example, is secured within the housing 11. A heater control 13 is disposed on a side of the water tank 12 within the housing 11 which is coupled to a heating element 14 disposed inside of the water tank 12 (shown in FIGS. 4 and 5). All components of the hot water dispensing system 10 are secured together by means of metal or plastic screws (some of which are shown but not numbered).

A temperature control knob 15 is secured to a thermostat 16 that is coupled to the heater control and senses and controls the temperature of water in the water tank 12 in conjunction with the heater control 13 and heating element 14. Electrical wiring is coupled from a power plug 17 to the heater control 13, the thermostat 16 and to a ground connection 18.

A water inlet tube 21 at the top of the housing 11, for example, is connected to a cold water source, such as a cold water faucet valve. The inlet tube 21 is connected to an inlet passage of an orifice block 22, which is secured thereto using a plastic nut 23, for example. The orifice block 22 is secured to a variable volume expansion chamber 30, for example, by way of a flange 45 and screws. A suction passage 44 (FIGS. 7*a*, 7*b*) of the orifice block 22 is connected to the variable volume expansion chamber 30.

Figure 28:
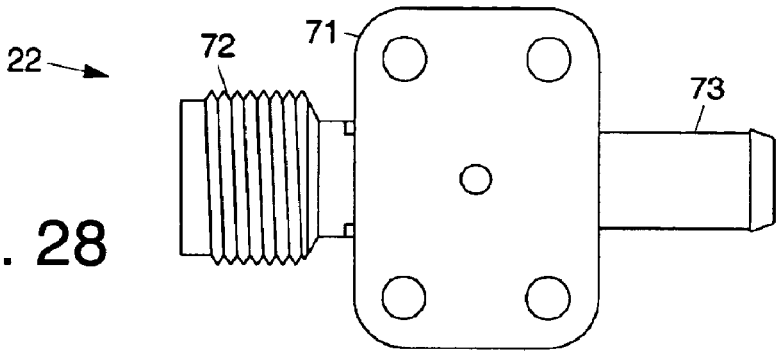
FIGS. 28, 29, 30 and 31 show bottom, cross-sectional, top and end views, respectively, of an exemplary orifice block that may be used in the present hot water dispensing systems.
Figure 29:
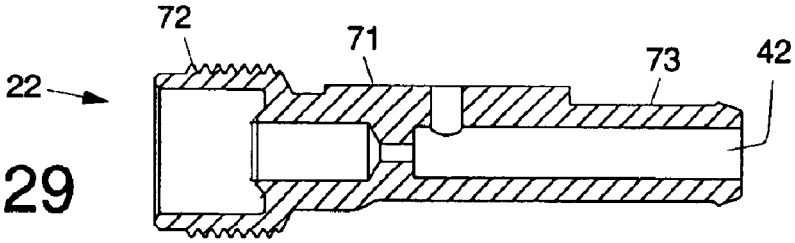
Figure 30:
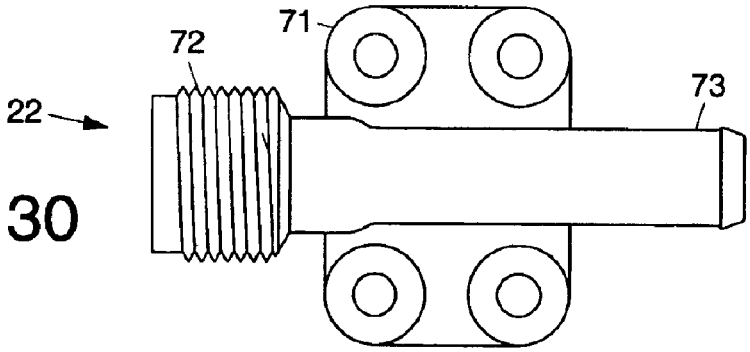
Figure 31:
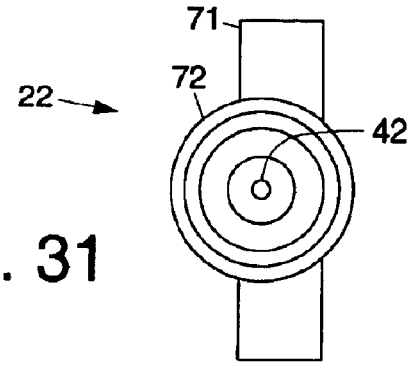

An outlet passage 73 (FIGS. 28–30) of the orifice block 22 is coupled to an inlet hose 24 that is connected to an water inlet the bottom of the water tank 12. An outlet tube 25 is located at the top of the water tank 12. A discharge hose 26 (shown in FIGS. 6 and 7) is attached to the output tube 25 at the top of the water tank 12 and is coupled to a faucet 27 (generally designated in FIGS. 6 and 7).

FIGS. 4 and 5 illustrate an exemplary heater control 13 and heating element 14, respectively, that may be used in the present hot water dispensing system 10. FIG. 5 is a cross sectional view of FIG. 4 taken along the lines 5—5 in FIG. 4. The heater control 13 is secured to the outside wall of the water tank 12. The heating element 14 is disposed on the inside of the water tank 12 and is electrically coupled to the heater control 13. A silicon seal (not shown) is used to seal the wall of the water tank 12 where the heater control 13 is attached to it.

FIGS. 6 and 7 illustrate additional details of the hot water dispensing system 10 along with operation of the present invention. FIGS. 6 and 7 also shows details of the variable volume expansion chamber 30. The variable volume expansion chamber 30 comprises a plastic housing 31, for example, made up of first and second mating sections 31*a*, 31*b*. Components of the variable volume expansion chamber are designed to withstand pressures of at least 300 pounds per square inch. More particularly, a reduced-to-practice embodiment of the variable volume expansion chamber 30 has been tested to 300 PSI and has been found to withstand such pressures. However, it is to be understood that the volume expansion chamber 30 will only be exposed to pressures that are generated by household water supplies.

A vent hole 32 is disposed in one of the mating sections 31*a*, 31*b*. A flexible bladder 33 is secured between the two mating sections 31*a*, 31*b* which is free to move laterally within the expansion chamber 30. Enlarged views showing details of the components of the expansion chamber 30 are illustrated in FIGS. 8–16.

Referring to FIGS. 7*a*, 7*b*, they illustrate details of the orifice block 22. The orifice block 22 comprises an inlet passage 41, an orifice 42, and an output passage 43 that is coupled to a suction passage 44. The orifice 42 is smaller in diameter than the inlet passage 41, and is located between the inlet and outlet passages 41, 43 of the orifice block 22. The suction passage 44 connects to the expansion chamber 30. The suction passage 44 couples the expansion chamber 30 to the orifice block 22.

Figure 8:
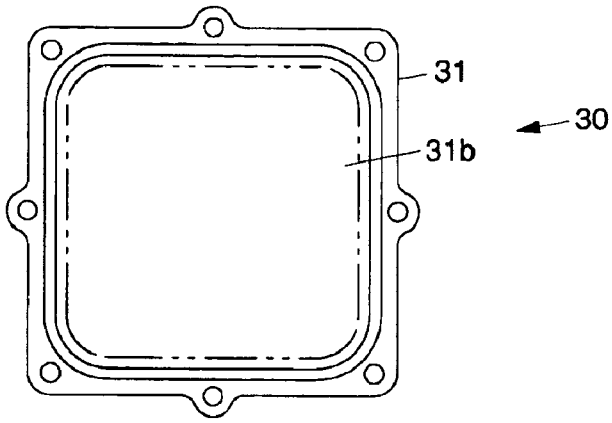
FIGS. 8, 9 and 10 are plan, side and section views, respectively, of an exemplary bladder that may be used in the variable volume expansion chamber.
Figure 9:
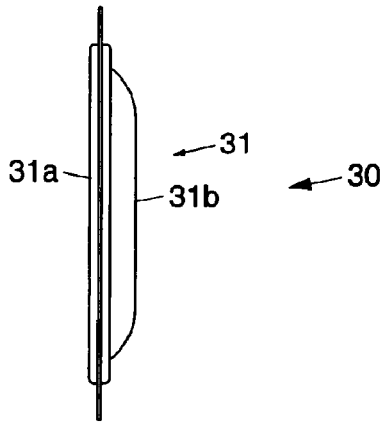
Figure 10:
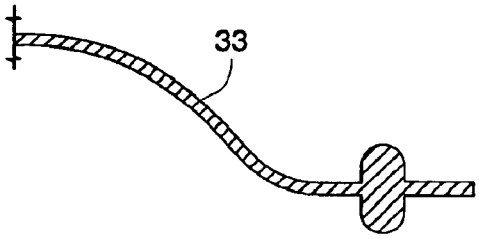

FIGS. 8 and 9 are plan and side views, respectively, of an exemplary variable volume expansion chamber 30 that may be used in the present hot water dispensing system 10. FIG. 10 shows a cross-section of a portion of an exemplary bladder 33 that may be used in the variable volume expansion chamber 30. The bladder 33 is preferably made of silicone material. The bladder 33 is secured between the first and second mating sections 31*a*, 31*b*. The variable volume expansion chamber 30 provides for one particularly novel aspect of the present invention.

Figure 11:
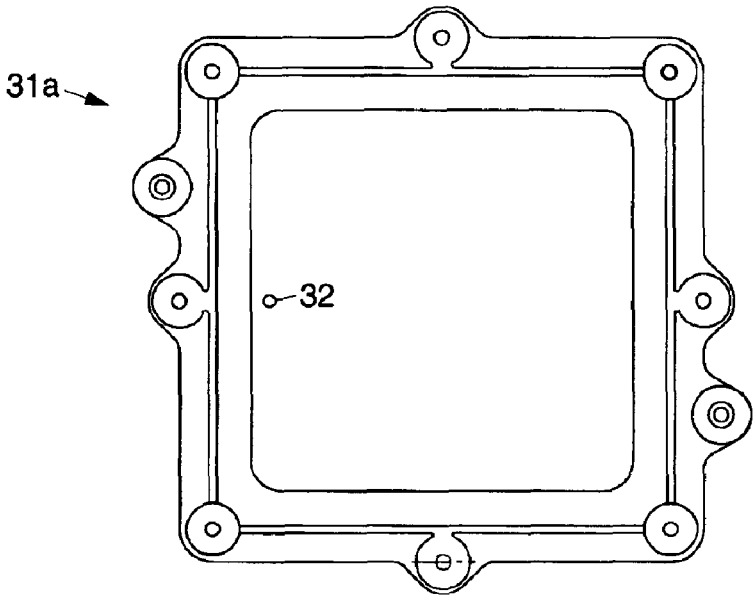
FIGS. 11, 12 and 13 illustrate outside, cross-sectional and inside views, respectively, of a first mating section of the exemplary variable volume expansion chamber housing shown in FIGS. 6 and 7.
Figure 12:
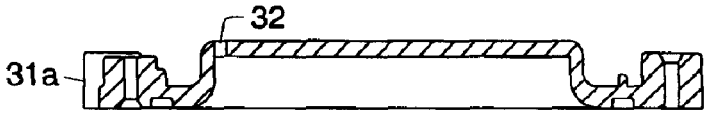
Figure 13:
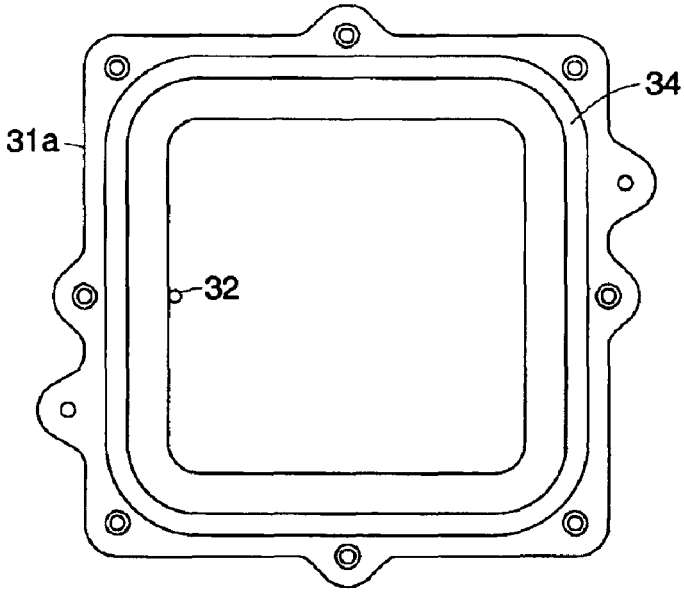

FIGS. 11, 12 and 13 illustrate outside, cross-sectional and inside views, respectively, of the first mating section 31*a* of the exemplary variable volume expansion chamber 30. FIGS. 11, 12 and 13 the location of the vent hole 32, along with the location of one portion of a groove 34 into which the bladder 33 is secured.

FIGS. 14, 15 and 16 illustrate outside, cross-sectional and inside views, respectively, of the second mating section 31*b* of the exemplary variable volume expansion chamber 30. The second mating section 31*b* includes the flange 45 that has the suction passage 44 formed within it.

Figure 17:
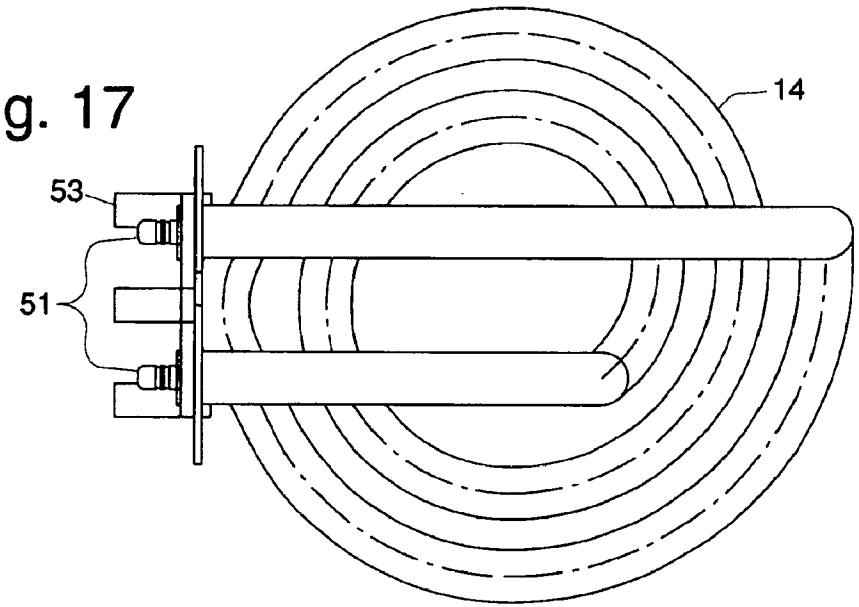
FIGS. 17, 18 and 19 illustrate top, side and end views, respectively, of the exemplary heating element shown in FIGS. 4 and 5.
Figure 18:
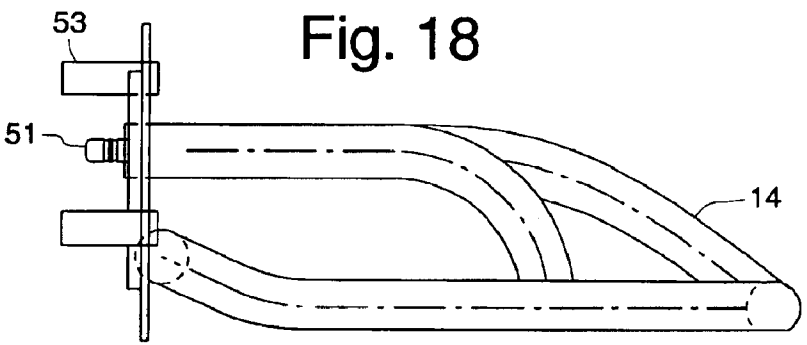
Figure 19:
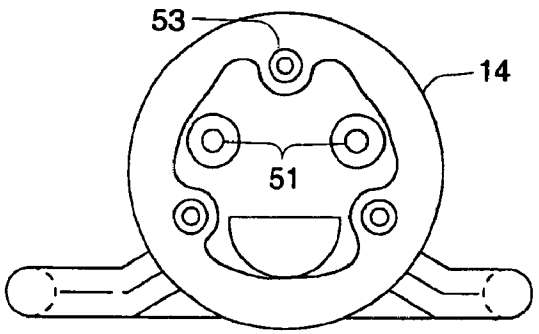

FIGS. 17, 18 and 19 illustrate top, side and end views, respectively, of the exemplary heating element 14 shown in FIGS. 4 and 5. The heating element 14 comprises a plurality of contacts 51 that connect to mating contacts 52 (FIGS. 20, 21) of the heater control 13. Three threaded screw holes 53, for example, are provided to secure the heating element 14 to the heater control 13.

Figure 21:
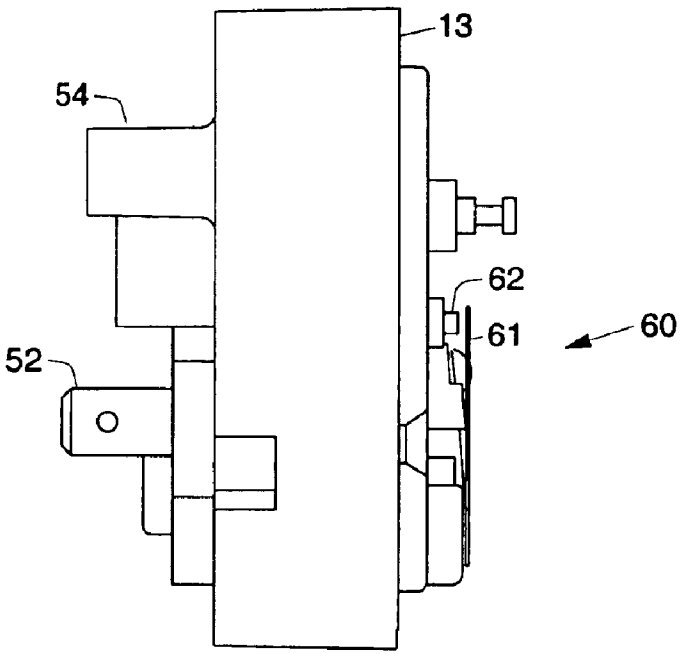
FIGS. 20 and 21 show top and side views, respectively, of the exemplary heater control shown in FIGS. 4 and 5.
Figure 20:
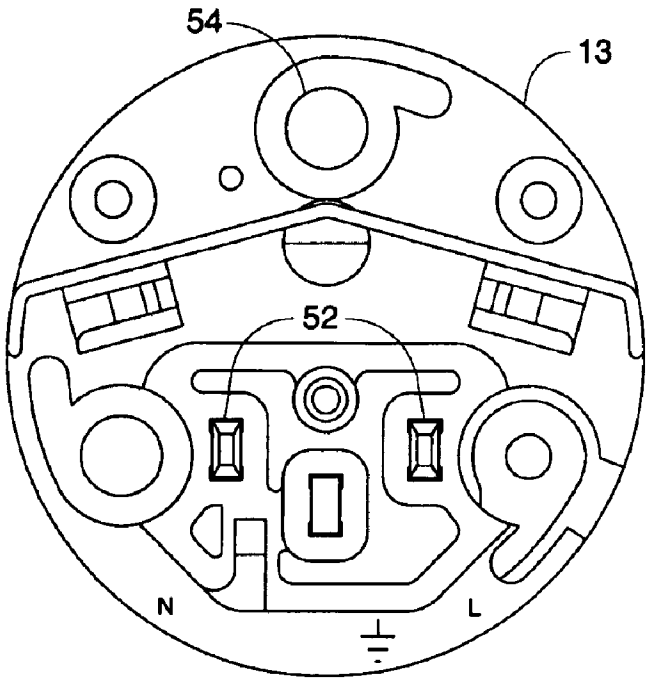

FIGS. 20 and 21 show top and side views, respectively, of the exemplary heater control 13 shown in FIGS. 4 and 5. The heater control 13 may be a heater control unit manufactured by Strix, Ltd., located on the Isle of Man in the United Kingdom. The heater control 13 comprises the plurality of contacts 52 that connect to the mating contacts 51 (FIGS. 20, 21) of the heating element 14. Three connectors 54 are provided on the heater control 13 that are secured to the threaded screw holes 53 of the heating element 14.

The heater control 13 comprises a self-resetting heater control switch 60, shown at the right side of FIG. 21. The self-resetting heater control switch 60 used in the heater control 13 provides for another particularly novel aspect of the present invention.

The self-resetting heater control switch 60 comprises a bimetallic switch 60 having two contacts 61, 62. The self-resetting heater control contact 60 opens and turns off power to the heater control 13, and thus the heating element 14, if the temperature of the heating element 14 rises due to the fact that there is no water in the water tank 12.

Figure 22:
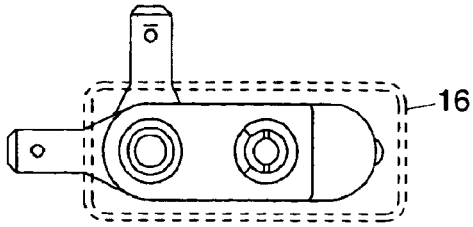
FIGS. 22 and 23 show top and side views, respectively, of an exemplary thermostat that may be used in the present hot water dispensing systems.
Figure 23:
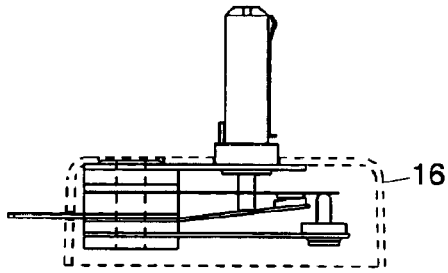

FIGS. 22 and 23 show top and side views, respectively, of an exemplary thermostat 16 that may be used in the hot water dispensing system 10. The exemplary thermostat 16 may be one manufactured by Sammax, for example.

Figure 24:
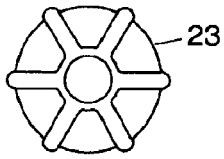
FIGS. 24 and 25 show top and cross-sectional views, respectively, of an exemplary retaining nut that may be used in the present hot water dispensing systems.
Figure 25:
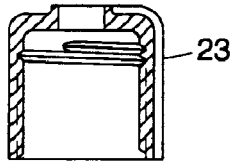

FIGS. 24 and 25 show top and cross-sectional views, respectively, of an exemplary retaining nut 23 that may be used in the hot water dispensing system 10. The retaining nut 23 is preferably molded out of plastic and is used to connect the inlet tube 21 to the orifice block 22.

Figure 26:
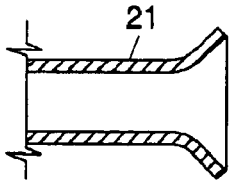
FIGS. 26 and 27 show partial cross-sectional and side views, respectively, of an exemplary inlet tube that may be used in the present hot water dispensing systems.
Figure 27:
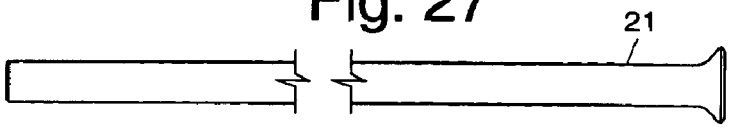

FIGS. 26 and 27 show partial cross-sectional and side views, respectively, of an exemplary inlet tube 21 that may be used in the hot water dispensing system 10.

FIGS. 28, 29, 30 and 31 show bottom, cross-sectional, top and end views, respectively, of an exemplary orifice block 22 that may be used in the hot water dispensing system 10.

The orifice block 22 comprises a flange 71 that is used to connect it to the variable volume expansion chamber 30. The orifice block 22 also comprises a threaded section 72 to which the retaining nut 23 is secured to attach the inlet tube 21 to the orifice block 22. The orifice block 22 also comprises an outlet 73 to which the inlet hose 24 is connected.

Referring again to FIGS. 6 and 7, operation of the hot water dispensing system 10 will be discussed. When operating the hot water dispensing system 10 in a non-dispensing/heating mode, if the dispensing system 10 is not use for a while, the heating element 14 cycles from on to off under control of the heater control 13. When the heating element 14 is shut down by the thermostat 16, the temperature of the water in the tank 12 and water level in the tank 12 are at their highest. When the heating element 14 comes on, the water temperature will be slightly lower as will the water level.

When dispensing hot water from the dispensing system 10, incoming cold water from the faucet valve creates a venturi effect at the orifice 42, creating a vacuum in the suction passage 44, pulling to the right in FIG. 7*a* With the initial water dispensing, the vacuum in the suction passage 44 begins to evacuate water from the variable volume expansion chamber 30, and the bladder 33 in the variable volume expansion chamber 30 begins to shift to the right, as shown at the left side of FIG. 7. With continued dispensing of water, the variable volume expansion chamber 30 empties until no water remains in the expansion chamber 30, while the bladder 33 shifts fully to the right, as shown at the left portion of FIG. 7.

When the faucet valve is opened, cold water enters the water tank 12 at the bottom, and hot water exits the water tank 12 at the top and discharges at the faucet 27. When the faucet valve is closed (the faucet valve is upstream from the variable volume expansion chamber 30), water flows back from the discharge hose 26 and the top of the water tank 12, filling the variable volume expansion chamber 30, as is shown in FIG. 6.

As water heats and expands, the added expansion of the water volume is less than the output at the faucet 27. Except for back pressure created by the faucet 27, created by the faucet 27, the water tank 12 is never under pressure.

For the variable volume expansion chamber 30 to function most efficiently, at least one cup of water should be dispensed at one time. Dispensing water in smaller amounts may not allow the variable volume expansion chamber 30 to fully empty and thereby decrease the normal water level in the water tank 12. With heating, the water in the water tank 12 expands and may result in dripping if it fills the discharge hose 26. It is preferable that a cup of water be dispensed from the water tank 12 after drawing a smaller amount to keep the system 10 in proper balance. Also, back pressure created by the faucet 27 may cause dripping during heating of water.

Thus, improved hot water dispensing systems employing a self-resetting heater control switch that prevents heater burn-up and a variable volume expansion chamber have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A hot water dispensing system comprising:

an outer housing;

a water tank comprising an inlet and an outlet disposed within the housing;

a heating element disposed inside of the water tank;

a heater control disposed within the housing that is coupled to the heating element;

a thermostat coupled to the heater control that senses and controls the temperature of water in the water tank in conjunction with the heater control and heating element;

an inlet tube for connection to a cold water source;

a variable volume expansion chamber comprising a flexible internal bladder and whose components are designed to withstand a pressure of at least 300 pounds per square inch;

an orifice block comprising an input passage coupled to the inlet tube, a suction tube coupled to the variable volume expansion chamber, and an outlet passage coupled to the inlet of the water tank;

a discharge hose coupled to the outlet of the water tank for connection to a faucet.

2. The system recited in claim 1 further comprising a self-resetting heater control switch that turns off power to the heating element when there is no water in the water tank.

3. The system recited in claim 1 wherein the outer housing comprises metal.

4. The system recited in claim 1 wherein the water tank comprises stainless steel.

5. The system recited in claim 1 wherein the variable volume expansion chamber comprises plastic.

6. The system recited in claim 1 wherein the self-resetting heater control switch comprises bimetallic switch contacts.

7. The system recited in claim 1 wherein the variable volume expansion chamber comprises first and second mating sections, a vent hole disposed in one of the mating sections, and a flexible bladder secured between the mating sections which is free to move laterally within the expansion chamber.

8. The system recited in claim 7 wherein the first and second mating sections comprise plastic and the flexible bladder comprises silicone.

9. A hot water dispensing system comprising:

an outer housing;

a water tank comprising an inlet and an outlet disposed within the housing;

a heating element disposed inside of the water tank;

a heater control disposed within the housing that is coupled to the heating element and that comprises a self-resetting heater control switch that turn off power to the heating element there is no water in the water tank;

a thermostat coupled to the heater control that senses and controls the temperature of water in the water tank in conjunction with the heater control and heating element;

an inlet tube for connection to a cold water source;

a variable volume expansion chamber comprising a flexible internal bladder;

an orifice block comprising an input passage coupled to the inlet tube, a suction tube coupled to the variable volume expansion chamber, and an outlet passage coupled to the inlet of the water tank;

a discharge hose coupled to the outlet of the water tank for connection to a faucet.

10. The system recited in claim 9 wherein the variable volume expansion chamber is designed to withstand a pressure of at least 300 pounds per square inch.

11. The system recited in claim 9 wherein the variable volume expansion chamber comprises plastic.

12. The system recited in claim 9 wherein the outer housing comprises metal.

13. The system recited in claim 9 wherein the water tank comprises stainless steel.

14. The system recited in claim 9 wherein the self-resetting heater control switch comprises bimetallic switch contacts.

15. The system recited in claim 9 wherein the variable volume expansion chamber comprises first and second mating sections, a vent hole disposed in one of the mating sections, and a flexible bladder secured between the mating sections which is free to move laterally within the expansion chamber.

16. The system recited in claim 15 wherein the first and second mating sections comprise plastic and the flexible bladder comprises silicone.

* * * * *